US005353816A

United States Patent [19]

Ehling et al.

[11] Patent Number: 5,353,816

[45] Date of Patent: Oct. 11, 1994

[54] FOIL FILAMENTS CONTAINING TOBACCO AND METHOD AND APPARATUS FOR THE PRODUCTION THEREOF

[75] Inventors: Uwe Ehling, Elmshorn; Jürgen Nüsslein, Wedel; Wilfried Stiller, Holm, all of Fed. Rep. of Germany

[73] Assignee: B.A.T. Cigarettenfabriken GmbH, Hamburg, Fed. Rep. of Germany

[21] Appl. No.: 878,998

[22] Filed: May 6, 1992

[30] Foreign Application Priority Data

May 27, 1991 [DE] Fed. Rep. of Germany ..... 4117307

[51] Int. Cl.[5] ..... A24B 3/00; A24C 5/18

[52] U.S. Cl. ..... 131/367; 131/77; 131/111; 131/119; 131/364

[58] Field of Search ..... 131/364, 367, 111, 119, 131/347, 329, 230, 77, 79, 84.2

[56] References Cited

U.S. PATENT DOCUMENTS

| | | | |
|---|---|---|---|
| 2,389,104 | 11/1945 | Bauer et al. . | |
| 3,096,772 | 7/1963 | Korber | 131/364 X |
| 3,646,943 | 3/1972 | Blewitt et al. | 131/370 |
| 4,391,285 | 7/1983 | Burnett et al. | 131/367 X |
| 4,510,950 | 4/1985 | Keritsis et al. | 131/375 X |
| 4,632,131 | 12/1986 | Burnett et al. | 131/79 X |
| 4,637,410 | 1/1987 | Luke | 131/360 X |
| 4,649,945 | 3/1987 | Norman et al. | 131/336 |
| 4,893,639 | 1/1990 | White | 131/375 X |
| 5,016,656 | 5/1991 | McCurtrie et al. | 131/364 |
| 5,027,836 | 7/1991 | Shannon et al. | 131/194 |

FOREIGN PATENT DOCUMENTS

| | | | |
|---|---|---|---|
| 0039647 | 11/1981 | European Pat. Off. | 131/77 |
| 0216926 | 4/1987 | European Pat. Off. . | |
| 1692917 | 12/1971 | Fed. Rep. of Germany . | |
| 1432576 | 8/1973 | Fed. Rep. of Germany . | |
| 1782854 | 3/1975 | Fed. Rep. of Germany . | |
| 2118472 | 2/1982 | Fed. Rep. of Germany . | |
| 3339247 | 5/1985 | Fed. Rep. of Germany . | |
| 4005656 | 9/1991 | Fed. Rep. of Germany . | |

*Primary Examiner*—Jennifer Bahr

*Attorney, Agent, or Firm*—Armstrong, Westerman, Hattori, McLeland & Naughton

[57] ABSTRACT

The invention relates to tobacco-containing foil filaments comprising tobacco particles, water, binding agents and moisturizing agents and having a substantially partially circular or closed circular cross-section, and to a method and apparatus for producing said foil filaments.

14 Claims, 5 Drawing Sheets

FOIL FILAMENTS CONTAINING TOBACCO AND METHOD AND APPARATUS FOR THE PRODUCTION THEREOF

BACKGROUND OF THE INVENTION

1. Field of the Invention

The invention relates to foil filaments containing tobacco and comprising tobacco particles, water, binding agents and moisturizing agents and to a method and apparatus for producing foil filaments containing tobacco.

2. Description of the Prior Art

In the tobacco-processing industry, a large number of possibilities are known for processing residues of the tobacco processing. For instance, DE-PS 1,782,854 discloses a nozzle having a plurality of nozzle passages for producing tobacco rods from tobacco waste which on the one hand comprises an outlet extension which is disposed at each mouth region of each nozzle passage and which is provided only over a portion of the periphery of the corresponding nozzle passage. On the other hand, each nozzle passage may comprise in its mouth region an outlet insert which has different coefficients of friction at opposite sides. If a raw mass containing tobacco is now pressed through the nozzle mouths, substantially helical tobacco rods are formed which however have only a low stability and a low filling power.

DE-OS 1,692,917 discloses a method of producing smoking tobacco employing a nozzle head in which a rotatable frustroconical insert is disposed.

DE-PS 1,432,576 discloses a method for producing smoking tobacco for utilizing tobacco constituents which are collected in the processing of tobacco. For this purpose, the tobacco raw mass is rolled out between two rollers, the resulting tobacco rod being torn into individual pieces due to different peripheral velocities and discharge velocities of the tobacco material. This method also gives only unstable results which moreover have a relatively low filling power.

A further method is known from EP 0 039 647 B1 in which a tobacco-containing raw mass is pressed via an extrusion device through a sort of mesh sieve, thereby forming tobacco-containing filaments or tobacco rods. A further method and an apparatus for producing crimped fibre pieces from reprocessed tobacco can be seen from DE 33 39 247 C1. In the latter, a tobacco-containing raw mass is expelled via an extrusion device from a special nozzle head in which a frustroconical insert is disposed and is divided into filamentary intermediate products. The tobacco-containing filaments which result therefrom also have the disadvantages of the prior art discussed above. This also applies to the method according to DE 40 05 656 A1, which relates essentially to a drying and expansion apparatus following the apparatus according to DE 33 39 247 C1.

EP 216 926 A1 relates to a method for producing tobacco-containing foil filaments, and as in the method according to DE-PS 1,432,576 a tobacco mass is rolled out between a roller pair to form a tobacco-containing material web and thereafter scraped from one of the rollers by a doctor blade. Here as well, the stability and filling power of the product leave much to be desired.

Finally, from DE 31 18 472 A1 a tobacco product is known, and a method for the production thereof, in which a raw mass containing tobacco material is expelled from a nozzle mouth via a mandrel. The resulting tobacco material hose then has approximately the diameter of a commercially usual cigarette. At certain intervals, corresponding to the length of commercially usual cigarettes, a portion of a tobacco-containing raw mass closing the tobacco material hose is introduced via a passage led axially through the mandrel. As a result a continuous hose of tobacco material is formed which can be severed at the points defined by the sealing tobacco portions and thereby gives tobacco portions corresponding to a finished cigarette. However, here as well the completely different smoking behaviour and lack of acceptance by the consumer are a disadvantage.

SUMMARY OF THE INVENTION

The invention therefore has as its object to provide a tobacco-containing foil filament and a method and an apparatus for the production thereof which do not have the disadvantages of the prior art referred to above.

In particular, it is an objective of the present invention, proceeding from DE-PS 1,782,854, to provide a method and an apparatus with which tobacco-containing foil filaments according to the invention can be made which have increased stability and increased filling power.

The invention therefore proposes in tobacco-containing foil filaments comprising tobacco particles, water, binding agents and moisturizing agents, the improvement in which the foil filaments have a substantially partially circular or circular cross-section.

The invention further proposes in a method for producing tobacco-containing foil filaments from a raw mass of tobacco particles, binding agents, moisturizing agents and water, in which the raw mass is extruded through at least one opening, the improvement in which the raw mass is extruded through a gap between the or each opening and a moving inner core.

The invention further proposes in an apparatus for producing tobacco-containing foil filaments comprising an extruder and a die which follows the latter and has at least one passage terminating in an opening, the improvement in which within the passages movable inner cores are provided which at the opening of the passages have a somewhat smaller cross-section than the passages or openings of the passages.

Advantageous embodiments and variants of the method are defined in the subsidiary claims.

According to the present invention a tobacco-containing foil filament is made available which is produced using tobacco particles, water, binding agents and moisturizing agents, the individual foil filaments having a substantially closed circular or partially circular cross-section. As a result of this configuration, the foil filaments according to the invention are very stable and have excellent filling power. These advantageous properties are based on the static stability of a circular or partially circular cross-section, which can take up and distribute in particularly good manner all shearing, bending and compressive forces. On the other hand, this configuration results in the finished foil filaments being smokable like natural cut tobacco material. The burning behaviour of the foil filaments according to the invention is particularly uniform and thus advantageous.

During the production process a twisting and/or crimping of the foil filaments occurs if the production process is carried out accordingly. By the subsequent drying process the twisting and/or crimping can be intensified if the foil filaments according to the invention are at least partially open lengthwise. By the twisting or crimping of the foil filaments according to the invention their filling power can be further increased. The burning behaviour and other properties demanded of cut tobacco can also be positively influenced thereby.

The foil filaments according to the invention are produced in such a manner that they have a C, U or O-shaped cross-section. The foil filaments according to the invention advantageously have a length of about 1 to about 100 mm, lengths between 5 and 30 mm being preferred. Other lengths have proved impracticable because they are not suitable for subsequent further processing to a cigarette, since they are either too small and cannot be held in the tobacco structure of the cigarette or due to their excessive length tend to form balls and to some extent oppose the processing. The diameter of the foil filaments according to the invention should lie between about 0.5 and about 3 mm, preferably between 1 and 2 mm. These dimensions correspond approximately to the dimensions of the usually employed cut tobaccos, thereby enabling the experience gathered in the processing of cut tobaccos to be utilized. The wall thickness of the foil filaments should be about 0.1 to 0.3 mm, preferably 0.15 to 0.2 mm. Within the range of these dimensions it is possible to give the foil filaments according to the invention a natural burning behaviour and the necessary stability. The advantages of the expediently employed dimensions enumerated apply basically alternatively to all the dimensions of the foil filaments.

The method according to the invention for producing foil filaments is performed with extrusion of a raw mass consisting of tobacco particles, binding agents, moisturizing agents and water, the extrusion taking place through at least one small opening. Within the small openings, according to the invention movable inner cores are provided, the raw mass being forced through a gap between the opening edge and the inner core. The inner core may be arranged asymmetrically in the opening so that a C or U-shaped cross-section arises. By variations, a large number of different cross-sections can be generated for the foil filaments according to the invention.

If the inner core is rotated within the opening, coarser tobacco particles which become lodged between the bore and inner core are ground and thus a clogging of the nozzle outlet opening avoided. The opening or openings through which the raw mass is forced have a diameter of in particular about 0.5 to about 3 mm. Although other opening sizes are practicable, they result in foil filaments which do not correspond in their dimensions to the usually employed natural cut tobacco. Moreover, foil filaments with larger dimensions would be too rigid and thus brittle and could not be processed very well.

Analogously to the rotating of the inner cores, it is also possible to move the inner cores axially to and fro within the passages in front of the openings, the inner cores preferably being able to extend out or into the openings. The advantages thus achieved are comparable with those of the procedure with rotating inner cores.

The aforementioned advantages can be further enhanced if the inner cores are both rotated and reciprocated.

If the inner cores are arranged for example cyclically asymmetrically or symmetrically within the openings of the passages, it is possible to make the foil filaments alternately O-shaped to C-shaped along their length.

During the extrusion and the shaping process temperatures of about 20° C. to about 160° and pressures between about 10 bar and about 200 bar are employed. Within the range of these parameters it is possible to process the tobacco-containing raw mass gently and obtain the desired density for the foil filaments so that the latter have the desired stability and the other desired properties.

The tobacco particles employed have grain sizes which are less than about 0.4 mm. This ensures that the gap between the inner core and the opening or the inner core and the passages in front of the openings does not become clogged. If tobacco particles are contained in the raw mass which are larger than the aforementioned approximate 0.4 mm, the rotation and reciprocation of the inner cores has a positive effect in so far as larger tobacco particles are ground and crushed, thereby preventing the occurrence of inhomogeneities in the form of filaments or even clogging of the gaps between the openings and the inner cores.

The raw mass has a consistency which is readily processable when the ratio between the tobacco content, the binding agent and the moisturizing agent on the one hand and the water content on the other lies in the range from about 80: about 20 to about 60: about 40, preferably 70:30.

If during the production the direction of rotation of the inner core or the direction of rotation of the inner cores is changed at intervals, nucleations of clogging in the particularly narrow zones of the gaps between the inner cores and the opening edges or the inner cores and the passage walls can be avoided. This makes the production method still more effective and the quality of the foil filaments more uniform. The best method results can be achieved if the diameter of the inner core is between about 0.05 and about 0.15 mm smaller than the passage diameter or the opening diameter, the passage or opening diameter lying between about 0.5 and about 3 mm.

The apparatus for solving the problem set comprises an extruder and a die following the latter and having at least one passage terminating in an opening. According to the invention, within the passage or within the passages inner cores are provided which near the openings have a somewhat smaller cross-section than the passages or openings.

The inner cores are constructed as rotating shafts or piston rods. The rotating shafts can be set in rotation jointly via a transmission by a motor.

The inner cores may also be jointly connected to a piston rod for reciprocation. The inner cores constructed as shafts may also be jointly connected to the reciprocating piston rod. A drive shaft can be led through the piston rod. As a rule, the shafts or inner cores are moved about 1.5 mm in one direction and 1.5 mm in the other, i.e. cover a total distance of about 3 mm.

The geometrical dimensions of the individual technical components of the apparatus are so dimensioned that foil filaments having the dimensions indicated above can be made.

BRIEF DESCRIPTION OF THE DRAWINGS

Hereinafter the invention will be explained in detail with the aid of the Figures. Further features and advantages of the present invention will then be apparent. In the drawings.

DESCRIPTION OF THE PREFERRED EMBODIMENTS

Figure 1:
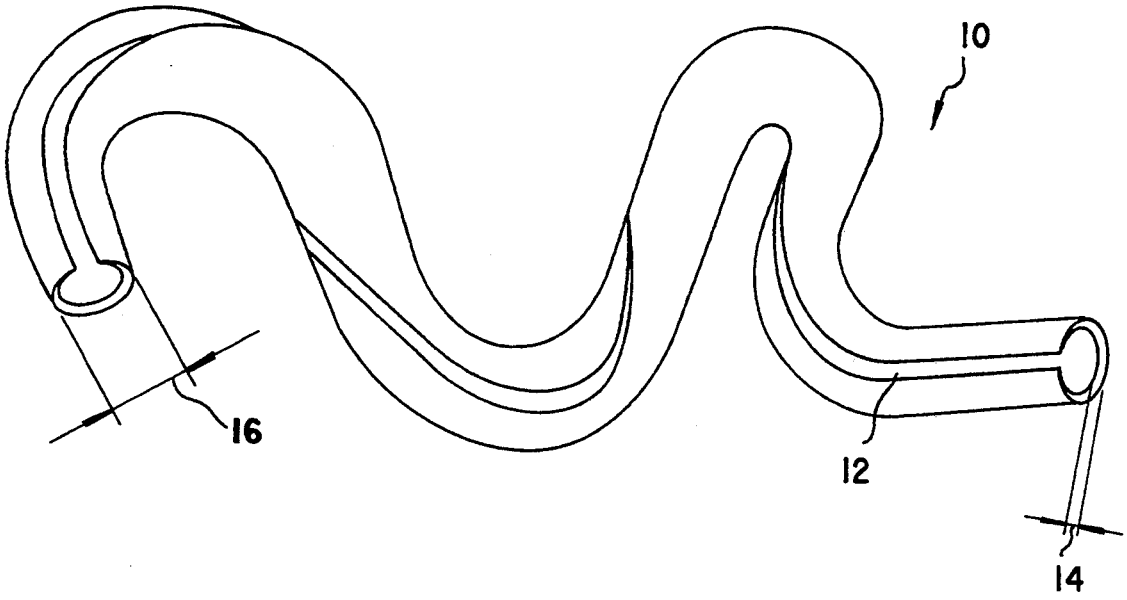
FIG. 1 is a perspective view of a foil filament.

In FIGS. 1 to 5 a hose-like, i.e. hollow foil filament, is denoted generally by the reference numeral 10.

A preferred embodiment of a tobacco-containing foil filament 10 can be seen in FIG. 1. The hose-like foil filament illustrated has a slot 12 formed over its entire length. This results in a C-shaped profile over the entire length of the foil filament 10. The wall thickness 14 of the foil filament 10 illustrated lies between 0.1 and about 0.3 mm, preferably between about 0.15 and 0.2 mm. The diameter 16 of the foil filament lies between about 0.5 and 3 mm, preferably between 1 and about 2 mm. The total length of the filament will as a rule not exceed 100 mm. Foil filament lengths of up to 30 mm can be processed like cut tobacco and are therefore preferably provided with these dimensions.

The foil filament according to FIG. 1 is made substantially C-shaped and is both twisted and crimped. In this manner the filling power of the foil filament according to the invention is substantially increased. The stability of the foil filament is governed mainly by the shape of the cross-section.

Figure 2:
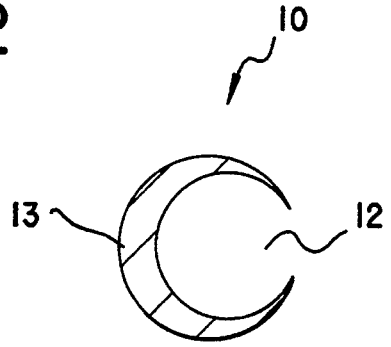
FIG. 2 shows a cross-section of the foil filament according to FIG. 1.

FIG. 2 shows a section through the C-shaped foil filament 10 with a longitudinal slot 12. It can be seen clearly that the foil filament is hollow on its inside. The thickness of the wall 13 of the foil filament 10 is usually not uniform but decreases towards the longitudinal slot 12.

Figure 3:
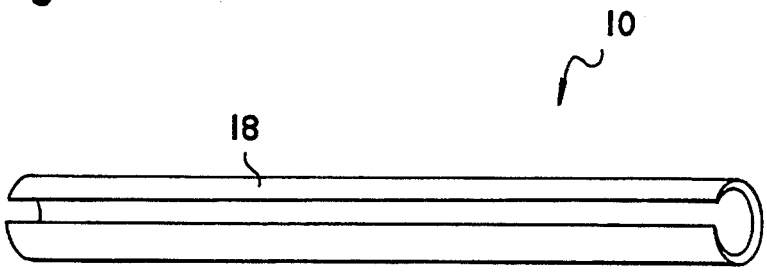
FIG. 3 is a side view of a straight foil filament.

The foil filament 10 according to FIG. 3 is straight, i.e. neither twisted nor crimped.

Figure 4:
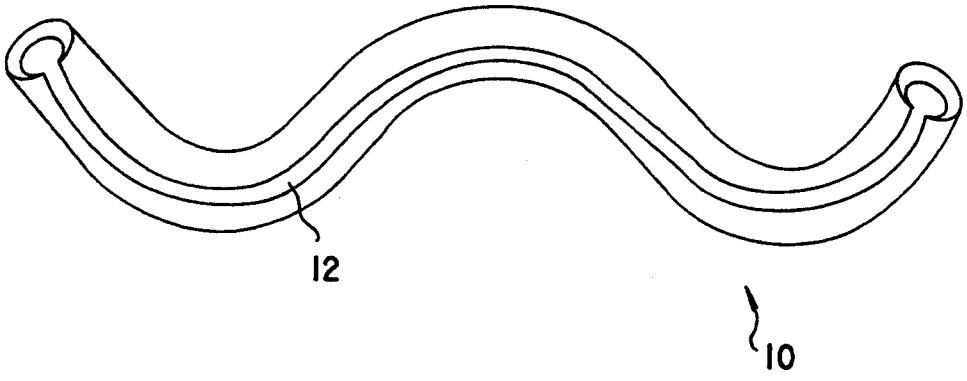
FIG. 4 shows a crimped foil filament.

The foil filament 10 according to FIG. 4 is only crimped but not twisted.

Figure 5:
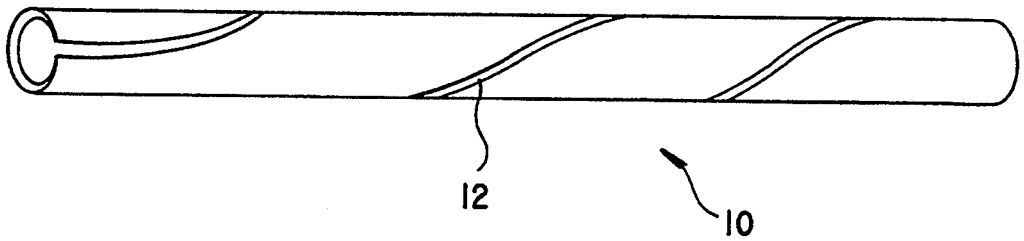
FIG. 5 shows a twisted foil filament.

The foil filament 10 according to FIG. 5 is only twisted but not crimped.

Figure 6A:
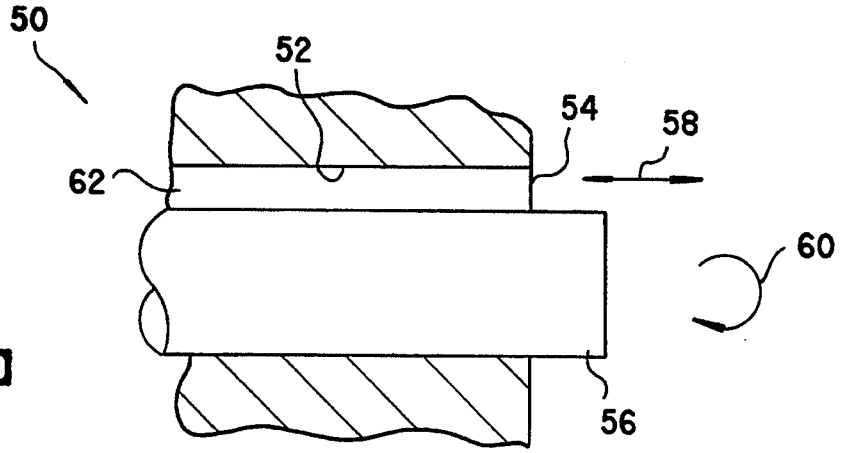
FIG. 6*a* and 6*b* show a side and front view of a passage or an opening with asymmetrically arranged movable inner core of the apparatus for producing the foil filaments.
Figure 6B:
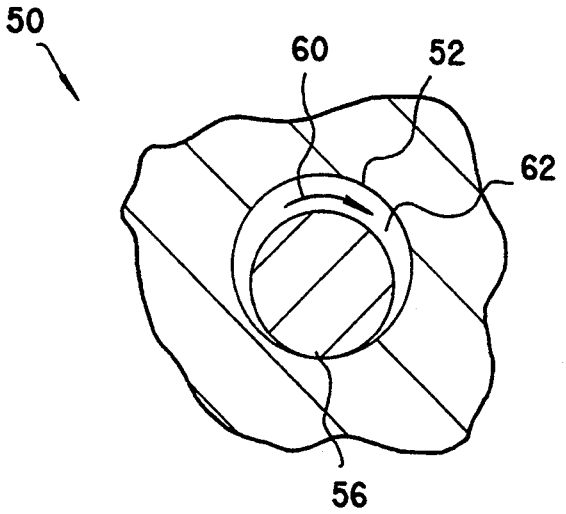

In FIGS. 6*a* and 6*b* a single opening 54 of a die according to the invention is shown, for producing tobacco-containing foil filaments according to the invention. In the longitudinal section according to FIG. 6*a* the path of a passage 62 between a wall 52 of the passage 62 and an inner core 56 can be seen. The inner core 56 executes a rotary movement about the arrow 60 and/or a reciprocal movement along the double arrow 58. Furthermore, the movement of the inner core 56 contributes to a twisting and crimping of the foil filament 10.

Further reasons for the twisting and crimping are the different extrudate velocity in the outlet gap 62 caused by the asymmetrical inner core 56, and irregular extrudate flow, caused by coarser tobacco particles becoming briefly clogged between the inner core 56 and wall 52 of the passage 62. The movement of the inner core 56 prevents clogging of the gap 62. Larger tobacco particles are ground. Nucleations from which stoppages of the gap 62 might result are prevented.

As can be seen from FIG. 6*b*, the inner core constructed as shaft 56 is arranged asymmetrically within the bore. The resulting gap 62 leads to the foil filament emerging from the gap 62 having the desired C-shape. In the region in which the inner core 56 bears on the wall 52 of the opening 54 or the wall 52 of the passage, the slot 12 of the C-shape of the foil filament 10 is formed.

Figure 7A:
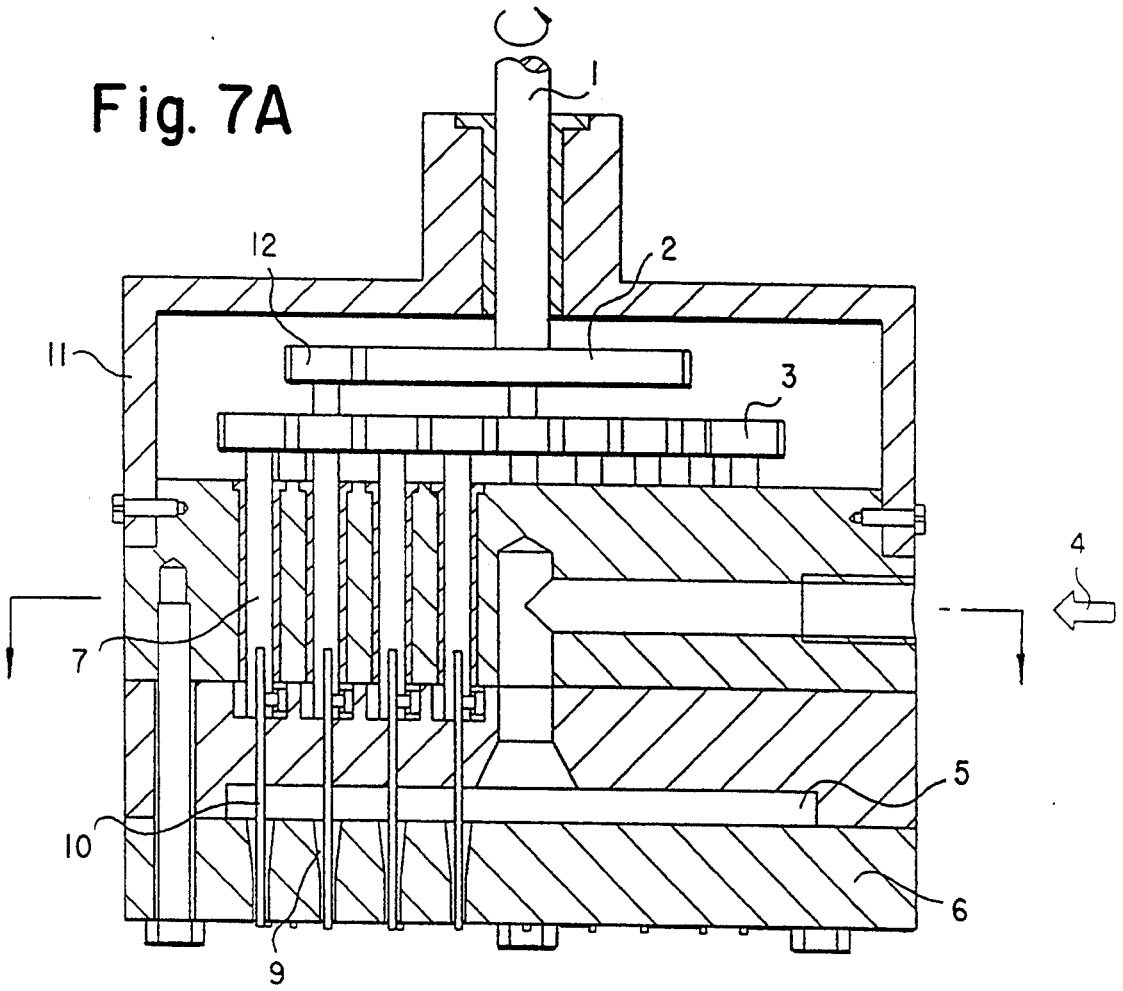
FIG. 7 shows a die with rotating inner cores.
Figure 7B:
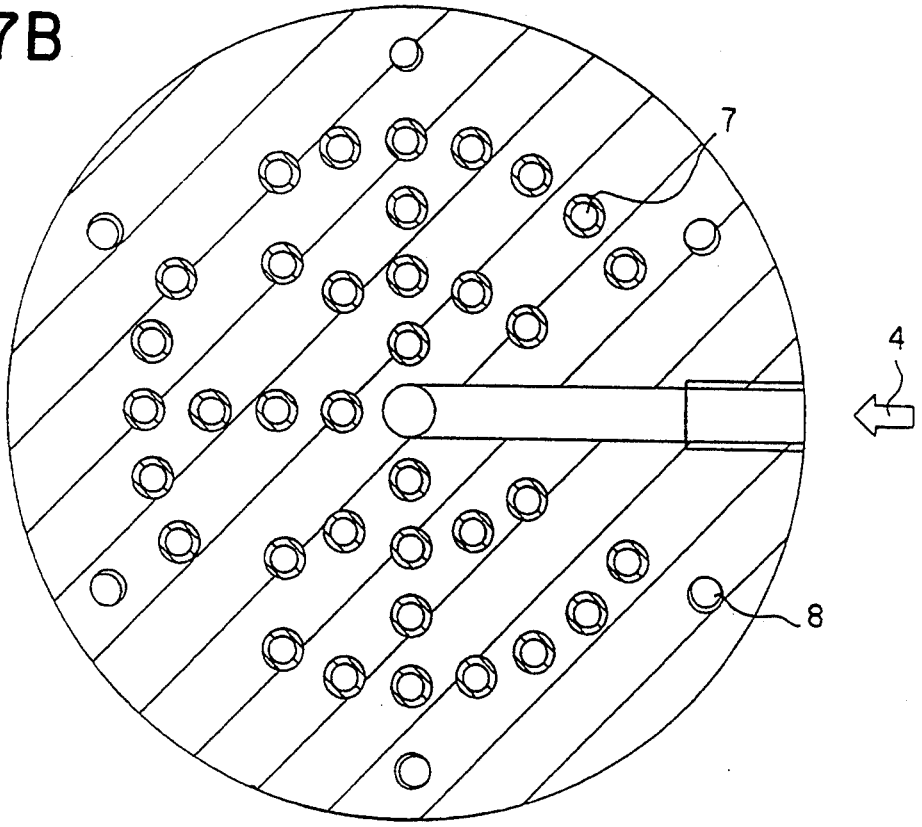

In FIG. 7 a die can be seen which is intended for carrying out the method and for producing the foil filaments. Disposed in front of the die is an extrusion apparatus or extrusion screw as is well-known in the art in a great variety of forms.

The die comprises a transmission housing 11 into which a shaft 1 opens. The shaft 1 transmits its rotary movement via a central gear 2 to three peripheral gears 12. These peripheral gears 12 are drivingly connected to 36 gears 3. The gears 3 are in engagement with their adjacent gears so that a great number of gears 3 can be driven via relatively few peripheral gears 12.

Connected to the gears 3 are needle retaining shafts 7 which rotate together with the gears 3. At the ends of the needle retaining shafts 7 opposite the gears 3 means are provided for clamping needles 10. The clamped needles 10 also rotate with the needle retaining shafts 7 or the gears 3. The needles 10 merge via a cavity 5 into nozzle outlet bores 9 which are provided in a cover plate 6. The mouths of the nozzle outlet bores 9 correspond to the opening 54 according to FIGS. 6*a* and 6*b*. The needles 10 are to be compared with the inner core 56 according to FIGS. 6*a* and 6*b*.

A raw mass is introduced into the die via an opening in the latter along the arrow 4 and passes through the passages and bores present into the cavity 5. From the latter, the raw mass is conducted through the nozzle outlet bores 9 and emerges at the end of the nozzle outlet bores 9 through a gap between the needles 10 and the opening. The raw mass introduced along the arrow 4 consists of tobacco particles, water, binding agents and moisturizing agents, the tobacco content, the binding agent and the moisturizing agent compared with the water content being about 80: about 20 to about 60: about 40, preferably 70:30.

The raw mass is heated and introduced under pressure into the die, which may be provided with a heating to maintain the raw mass at a constant temperature until it emerges from the openings of the nozzle outlet bores 9. The temperatures which are usually employed lie between about 20° C. and about 160° C. The pressure lies between about 10 bar and about 200 bar.

The diameter of the needles 10 is usually about 0.05 to about 0.15 mm smaller than the diameter of the nozzle outlet bores 9; the diameter of the nozzle outlet bores should lie between about 0.5 and about 3 mm.

The lower part of FIG. 7 shows a section through the upper part of the die illustrated in FIG. 7 at the level of the introduction region of the raw mass, i.e. the level of the arrow 4. The introduction bore through which the tobacco-containing raw mass is introduced along the arrow 4 can be clearly seen. Also visible are the needle retaining shafts 7 and their arrangement. The securing screws 8 for holding the cover plate 6 permit easy-maintenance assembly and disassembly of the die. This provides access to the cavity 5 via which the tobacco-containing raw mass is distributed and conducted to all the nozzle outlet bores. Likewise, the clamping means for the needles 10 provided on the needle retaining shafts 7 are thereby accessible.

In the die illustrated the needles 10 project beyond the open ends of the nozzle outlet bores 9.

The die illustrated in FIG. 7 has the following mode of operation: From an extruder preceding the tool illustrated the raw mass is introduced into the die along the arrow 4. Via correspondingly disposed conduits and passages or bores the raw mass reaches the cavity 5. In the cavity 5 the raw mass is distributed in such a manner that a plurality of nozzle outlet bores 9 can be supplied with raw mass. Whilst the raw mass emerges through the nozzle outlet bores 9 between the walls of said nozzle outlet bores 9 and the needles 10 provided asymmetrically in said bores 9, the needles 10 are rotated.

The asymmetrical position of the needles 10 within the nozzle outlet bores 9 results in the advantageous C-form of the foil filaments.

By the rotation of the needles 10 tobacco constituents in the raw mass having an excessive grain size, for example greater than 0.4 mm, can be ground and disintegrated. This also prevents the outlet openings 9 from becoming clogged. If the direction of rotation of the needles is cyclically altered, jammed or seized constituents of the raw mass can be freed again and ejected from a bore 9 together with the body of a foil filament. In addition, the rotation contributes to the twisting and crimping of the foil filaments.

Figure 8A:
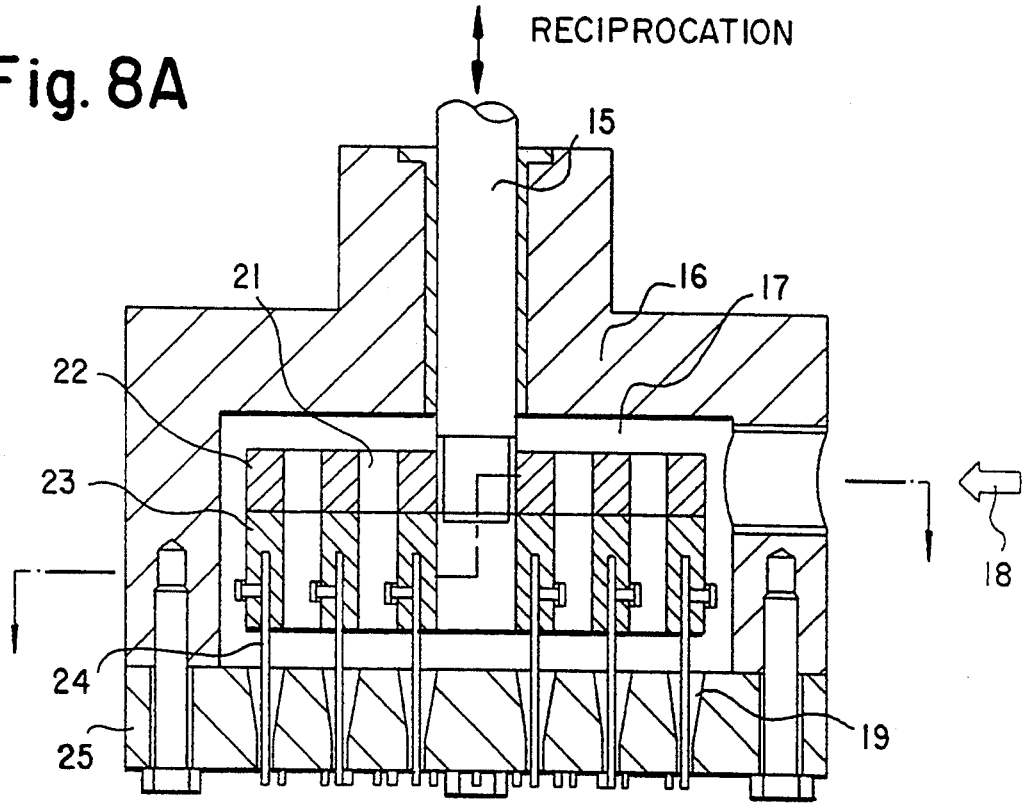
FIG. 8 shows a die with reciprocating inner cores.
Figure 8B:
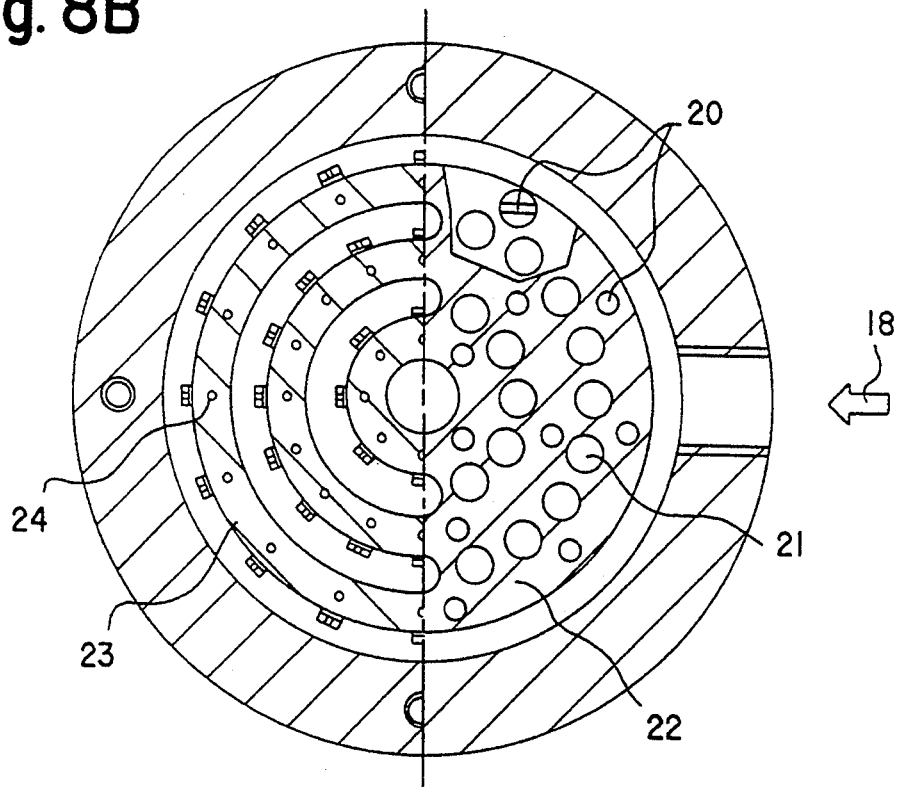

In FIG. 8 a further embodiment of a die is shown. In this case the needles 24 are not rotated but axially reciprocated via a piston rod 15.

Otherwise, the die according to FIG. 8 also consists of a nozzle housing 16 into which however the piston rod 15 enters from above. At the other end of the piston rod 15 the holding plate 22 and the needle securing ring 23 are provided. Within the nozzle housing 16 there is a cavity 17 to ensure adequate clearance for the necessary reciprocation and thus to ensure that the tobacco-containing raw mass introduced into the die along the arrow 18 can reach the nozzle outlet bores 19.

The arrangement of the needles 24 in the outlet bores 19 again corresponds to the form illustrated in FIGS. 6*a* and 6*b*. In this case as well the needles 24 project beyond the openings of the nozzle outlet bores 19 in the cover plate 25.

To enable the needles 24 to be exchanged, in the needle securing ring 23 clamping means are provided. Said clamping means are implemented by screws which when tightened clamp a needle 24 in punctiform or area manner. In the holding plate 22 and the needle securing ring 23 relief bores 21 are provided so that the tobacco-containing raw mass has adequate yield volume during the reciprocation of the piston rod 15 and the parts secured thereto. If such relief bores 21 were not present the entire raw mass would have to be transported via the outwardly disposed gaps and this would exert considerable shearing and bending forces on the thin needles 24 and result in high peak pressure values occurring.

The lower part of FIG. 8 shows two partial circular sections. The left partial circular section is made at the level of the clamping means whilst the right partial circular section extends through the bore through which the tobacco-containing raw mass is introduced into the die.

In the left part of the lower illustration of FIG. 8 the needle securing rings 23 can be seen. The needles 24 held by the clamping means are also apparent.

In the right partial section of the lower illustration in FIG. 8 the holding plate 22 can be seen, in which relief bores 21 are formed. Screws 20 are provided for securing the needle securing rings 23 to the holding plate 22. The tobacco raw mass to be processed is introduced into the die along the arrow 18.

The production method employed in the tool according to FIG. 8 is conducted in accordance with the method described for the die according to FIG. 7. The rotary movement of the needles 10 according to FIG. 7 is merely replaced by the reciprocation of the needles 24 according to FIG. 8.

For this purpose the dies according to FIGS. 7 and 8 are combined. Thus, for example, the shaft 1 according to FIG. 7 can execute a reciprocal movement in addition to the rotary movement. The transmission is then designed so that it can transmit this movement to the needles 9.

We claim:

1. Tobacco-containing foil filaments, comprising:

a plurality of foil filament bodies;

each of said plurality of foil filament bodies being composed of tobacco particles, water, binding agents and moisturizing agents, wherein each of said plurality of foil filament bodies has a substantially hollow, partially circular cross-section; and wherein each of said plurality of foil filament bodies has a hollow tubular shape having a longitudinal slit therein.

2. Tobacco-containing foil filaments according to claim 1, wherein each of said plurality of foil filament bodies are twisted and/or crimped.

3. A tobacco-containing hollow filament according to claim 1, wherein said hollow tubular filament body has a hollow tubular shape and has a C-shaped cross-sectional profile.

4. A tobacco-containing hollow filament according to claim 1, wherein said hollow tubular filament body has a hollow tubular shape and has a U-shaped cross-sectional profile.

5. A tobacco-containing hollow filament according to claim 1, wherein said hollow tubular filament body has a length in a range of about 5 mm to about 30 mm.

6. A tobacco-containing hollow filament according to claim 1, wherein said hollow tubular filament body has a diameter in a range of about 0.5 to about 3 mm.

7. A tobacco-containing hollow filament according to claim 1, wherein said hollow tubular filament body has a diameter in a range of about 1 mm to about 2 mm.

8. A tobacco-containing hollow filament according to claim 1, wherein said hollow tubular filament body has a wall thickness in a range of about 0.1 mm to about 0.3 mm on an average, and wherein the wall of said hollow tubular filament body have a varying thickness in cross-section.

9. A tobacco-containing hollow filament according to claim 1, wherein said hollow tubular filament body has a wall thickness in a range of about 0.15 mm to about 0.2 mm on an average, and wherein the wall of said hollow tubular filament body have a varying thickness in cross-section.

10. A tobacco-containing hollow filament according to claim 1, wherein said hollow tubular filament body has a length in a range of about 5 mm to about 30 mm, a diameter in a range of about 1 mm to about 2 mm, and a wall thickness in a range of about 0.15 mm to about 0.2 mm on an average, and wherein the wall of said hollow tubular filament body have a varying thickness in cross-section.

11. A tobacco-containing hollow filament according to claim 1, wherein said hollow tubular filament body has a length in a range of about 1 mm to about 100 mm, a diameter in a range of about 0.5 mm to about 3 mm, and a wall thickness in a range of about 0.1 mm to about 0.3 mm, on an average, and wherein the wall of said hollow tubular filament body have a varying thickness in cross-section.

12. Tobacco-containing foil filaments, comprising:

a plurality of foil filament bodies;

each of said plurality of foil filament bodies being composed of tobacco particles, water, binding agents and moisturizing agents, wherein each of said plurality of foil filament bodies has a substantially hollow, partially circular cross-section; and wherein each of said plurality of foil filament bodies are twisted.

13. A tobacco-containing hollow filament, comprising:

a hollow tubular filament body;

said hollow tubular filament body being composed of tobacco particles, water, binding agents and moisturizing agents, wherein an outer periphery of said hollow tubular filament body has a substantially circular peripheral cross-section;

wherein said hollow tubular filament body has a crescent-shaped cross-section; and wherein said hollow tubular filament body is twisted.

14. A tobacco-containing hollow filament, comprising:

a hollow tubular filament body;

said hollow tubular filament body being composed of tobacco particles, water, binding agents and moisturizing agents, wherein an outer periphery of said hollow tubular filament body has a substantially circular peripheral cross-section;

wherein said hollow tubular filament body has a crescent-shaped cross-section; and wherein said hollow tubular filament body is crimped.

* * * * *